United States Patent [19]

Wydra

[11] 4,159,044

[45] Jun. 26, 1979

[54] SAFETY WORKING LANYARD

[76] Inventor: Walter B. Wydra, 6195 Rush-Lima Rd., Rush, N.Y. 14543

[21] Appl. No.: 892,267

[22] Filed: Mar. 31, 1978

[51] Int. Cl.[2] ..... A62B 35/00

[52] U.S. Cl. ..... 182/3

[58] Field of Search ..... 182/3, 4, 9; 119/96

[56] References Cited

PUBLICATIONS

Atlas Safety Equipment Co., Inc. Catalog, Brooklyn, N. Y., Catalog No. 65.

*Primary Examiner*—Price C. Faw, Jr.
*Assistant Examiner*—Conrad L. Berman
*Attorney, Agent, or Firm*—Stonebraker, Shepard & Stephens

[57] ABSTRACT

A safety working lanyard interconnects with a D-ring on a safety belt to provide a safety line that is versatile and readily adjustable in length while in use. End hooks connectable to the D-ring are secured to each end of a length of safety line, and a working hook has an eye that is freely slideable along the length of the line and is also trapped between the end hooks. The end hooks are sized to pass through the D-ring on the belt and connect to the working hook, which is too large to pass through the D-ring and large enough to hook onto a ladder rung.

3 Claims, 4 Drawing Figures

SAFETY WORKING LANYARD

BACKGROUND OF THE INVENTION

The invention was developed as a safety line and working tool to protect and help firemen in many dangerous working situations on ladders and roofs, and it can be useful to other workers performing various tasks in dangerous places. Different working positions required during use of ground ladders, aerial ladders, and roof ladders on roofs of different pitch under many different circumstances confronted by firemen and other workers present a challenging variety of tasks for a safety working lanyard, and the invention meets many of these requirements in a simple, efficient, and convenient device. The invention aims at both safety and security for workers in high or dangerous places and flexibility, adjustability, and adaptability of a safety lanyard to a wide variety of working circumstances.

SUMMARY OF THE INVENTION

The inventive safety working lanyard is used with a belt having a connector ring. It includes a length of safety line, end hooks secured to each end of the line, and a working hook having an eye freely slideable along the length of the line. The end hooks are sized to pass through the connector ring on the belt and to hook to the connector ring, and the eye of the working hook is smaller than the end hooks so that the working hook is trapped between the end hooks. The working hook is also too large to pass through the connector ring. The safety line is adjustable in length without being disconnected during use, and the lanyard can be employed in many different ways by firemen and other workers in dangerous places.

DRAWINGS

FIG. 1 is a front elevational view of a preferred embodiment of the inventive safety working lanyard; and FIGS. 2–4 are schematic diagrams of different preferred ways of adjusting the working length of the lanyard of FIG. 1.

DETAILED DESCRIPTION

Figure 1:
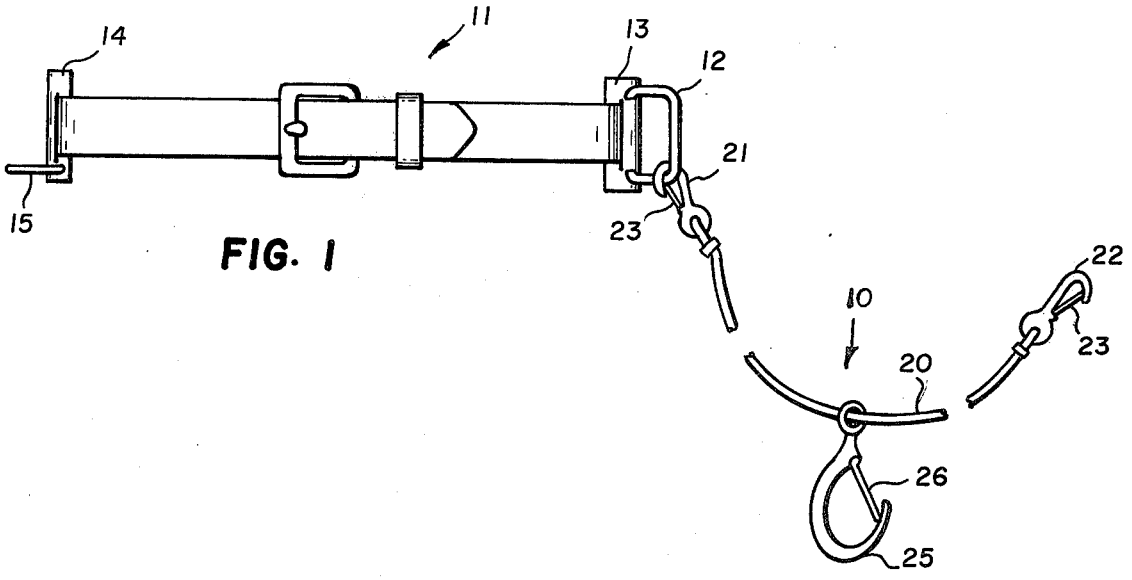

As best shown in FIG. 1, safety lanyard 10 cooperates with a safety belt 11 that is generally conventional and formed of sturdy materials to support the weight of a person. Belt 11 carries a connector ring preferably in the form of D-ring 12, and lanyard 10 interconnects with and cooperates with ring 12. A support 13 for mounting and holding D-ring 12 on belt 11 is preferably slideable along the length of belt 11 to be positioned in the most convenient place for each user. Belt 11 can also have more than one connector ring, and the position of the connector ring relative to the body of the wearer can be adjusted by moving the entire length of belt 11.

Belt 11 also preferably includes a tool holder loop 15 secured to belt 11 by a mounting device 14, with loop 15 being sized to hold a fireman's axe whenever the lanyard is intended for use by firemen. Other tool holders can also be added to belt 11.

Safety lanyard 10 includes a length of safety line 20 formed of any convenient material sturdy enough to support the weight of a person. Steel cable is preferred for use by firemen, because it is not likely to be weakened by heat or flames. Other conventional rope and cable making materials can also be used, however. Line 20 is preferably about two meters long so that both ends can be connected to ring 12 without dragging the lanyard under foot as the wearer moves about.

End hooks 21 and 22 are secured to each end of line 20 in a secure way such as by crimped or woven splices. End hooks 21 and 22 are preferably formed of metal and are preferably drop forged rather than cast to insure adequate strength for safety purposes. End hooks 21 and 22 are preferably provided with snaps 23 as illustrated for increased security.

A working hook 25 that is also preferably a drop forged steel hook having a protective safety snap 26 has an eye 27 through which line 20 passes so that hook 25 is freely slideable along the length of line 20. Eye 27 is small enough so that it will not pass over end hooks 21 and 22, which thereby trap working hook 25 securely between end hooks 21 and 22 on line 20.

End hooks 21 and 22 are sized relative to connector ring 12 so that the end hooks can pass through ring 12 and also hook onto ring 12, and working hook 25 is relatively larger and unable to pass through ring 12. End hooks 21 and 22 are also large enough to be hooked onto working hook 25, which is preferably large enough to hook onto a ladder rung.

The preferred embodiment of the inventive safety working lanyard as illustrated in FIG. 1 can be used in many ways to solve many problems safely and reliably. Initially the wearer preferably hooks both end hooks 21 and 22 to D-ring 12 on belt 11 while climbing to a position where the lanyard will be put to use. The approximately six foot or two meter length of lanyard 10 allows it to be worn this way without interferring with the wearer's movements. As the lanyard is put to use, one end hook 22 is disconnected from ring 12 to provide a two meter safety lanyard allowing positioning of working hook 25 anywhere along its length. Working hook 25 can be snapped onto a ladder rung 30 or other support to provide a safety line that is adjustable in length and usable in many ways as described below.

Figure 2:
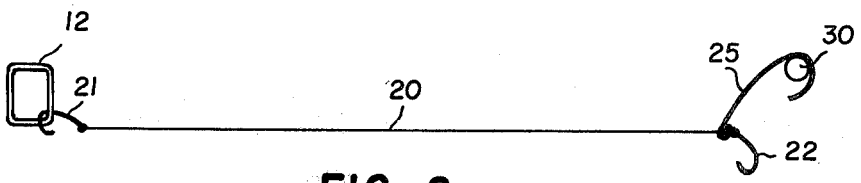

In the arrangement schematically shown in FIG. 2, hook 25 is snapped to a ladder rung 30 at the free end of line 20 to provide a safety line having a two meter scope for maximum freedom of movement of the wearer. This arrangement can be used to secure a fireman to a roof ladder as he transfers from a ground ladder to a roof ladder and can also be used to secure a fireman to the upper end of a roof ladder as he goes over the peak of the roof to work on the side of the roof opposite the roof ladder. This can be necessary depending upon wind conditions and other circumstances. The full scope of line 20 can also be used for securing a roof saw in place with hook 25, for raising and lowering people or equipment, for connecting two or more lanyards together, and for rappel work.

Figure 3:
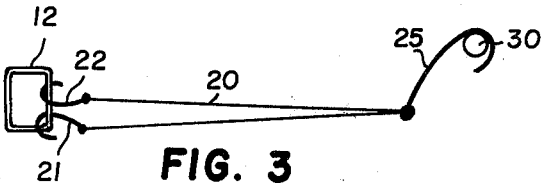
Figure 4:
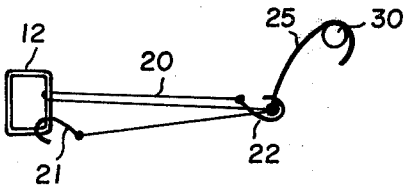

In many circumstances, a working line shorter than the full length of line 20 is desired; and this is readily achieved by the inventive lanyard without requiring disconnection to jeopardize the security of the wearer. For example, to change from the full length position of FIG. 2 to the half length position of FIG. 3, it is merely necessary to draw end hook 22 back to connector ring 12 so that working hook 25 is midway along safety line 20. Neither anchorage hook 21 nor working hook 25 has to be disconnected to do this, so that the wearer is secure even if he loses his grip during length adjustment. Similarly, to shorten from the one-half length of FIG. 3 to the one-third length of FIG. 4, the wearer merely passes end hook 22 through D-ring 12 and back to a position where end hook 22 can be hooked onto working hook 25. Although not illustrated, a one-quarter length arrangement can be made by passing end hook 22 through working hook 25 and returning it once more to connector ring 12.

Such easy length adjustment is advantageous in many circumstances. Firemen, for example, must be able to work on either side of a roof ladder on roofs having a wide range of pitch angles. On a steep roof, a fireman may prefer a relatively short length between belt 11 and a roof ladder and may triple or quadruple the lengths of line 20 between his belt and the ladder. On less steep roofs, he may prefer a longer working line because his belt is not so near the ladder in the most favorable working position. The ability of the inventive device to make easy length adjustments without disconnection adds considerable security for the user. Any slip occurring during a length adjustment is limited to about two meters because end hook 21 is preferably always secured to connector ring 12 and working hook 25 remains hooked to something during any length adjustment.

In addition to an adjustable length safety line, the cooperative arrangement of three hooks on line 20 allows the inventive lanyard to be used for securing objects or people, interconnecting two or more lanyards, and accomplishing many tasks for the safety and convenience of workers in dangerous places.

I claim:

1. A safety working lanyard for use with a belt having a connector ring, said lanyard comprising:

a. a length of safety line;

b. an end hook secured to each end of said line;

c. said end hooks being sized to pass through said connector ring and to hook onto said connector ring;

d. a working hook having an eye freely slideable along the length of said line;

e. said eye of said working hook being smaller than said end hooks so said working hook is trapped between said end hooks; and f. said working hook being too large to pass through said connector ring.

2. The lanyard of claim 1 wherein said end hooks are also sized to hook onto said working hook.

3. The lanyard of claim 1 wherein said working hook is large enough to hook onto a ladder rung.

4. The lanyard of claim 1 combined with a holder loop supported on said belt and sized to hold an axe.

5. The lanyard of claim 1 wherein said line is about two meters long.

6. The lanyard of claim 5 wherein said end hooks are also sized to hook onto said working hook.

7. The lanyard of claim 6 wherein said working hook is large enough to hook onto a ladder rung.

8. The lanyard of claim 7 combined with a holder loop supported on said belt and sized to hold an axe.

* * * * *